US008693716B1

(12) United States Patent
Siegumfeldt

(10) Patent No.: US 8,693,716 B1
(45) Date of Patent: Apr. 8, 2014

(54) HEARING DEVICE WITH ANALOG FILTERING AND ASSOCIATED METHOD

(71) Applicant: GN ReSound A/S, Ballerup (DK)

(72) Inventor: Peter Siegumfeldt, Frederiksberg (DK)

(73) Assignee: GN Resound A/S, Ballerup (DK)

( * ) Notice: Subject to any disclaimer, the term of this patent is extended or adjusted under 35 U.S.C. 154(b) by 0 days.

(21) Appl. No.: 13/720,652

(22) Filed: Dec. 19, 2012

(30) Foreign Application Priority Data

Nov. 30, 2012 (DK) ..... 2012 70744
Nov. 30, 2012 (EP) ..... 12195007

(51) Int. Cl.
*H04R 25/00* (2006.01)

(52) U.S. Cl.
USPC ..... 381/317; 381/312

(58) Field of Classification Search
None
See application file for complete search history.

(56) References Cited

U.S. PATENT DOCUMENTS

| | | | |
|---|---|---|---|
| 4,750,207 | A | 6/1988 | Gebert et al. |
| 5,170,434 | A | 12/1992 | Anderson |
| 5,285,502 | A | 2/1994 | Walton et al. |
| 2003/0007658 | A1 | 1/2003 | Meyer |
| 2004/0175012 | A1 | 9/2004 | Roeck et al. |
| 2012/0207315 | A1 | 8/2012 | Kimura et al. |
| 2012/0230502 | A1 | 9/2012 | Nishizaki et al. |

FOREIGN PATENT DOCUMENTS

| | | | |
|---|---|---|---|
| EP | 1 258 865 | A2 | 11/2002 |
| WO | 2011/006496 | A1 | 1/2011 |
| WO | 2013/009965 | A1 | 1/2013 |

OTHER PUBLICATIONS

Extended European Search Report dated Apr. 3, 2013 for EP Patent Application No. EP 12195007.5, 4 pages.
First Technical Examination and Search Report dated Apr. 25, 2013 for Danish Patent Application No. PA 2012 70744.
Notice of Reasons for Rejection (non-final office action) dated Feb. 4, 2014,for related JP Patent Application No. 2013-249039, 2 pages.

*Primary Examiner* — Brian Ensey
*Assistant Examiner* — Norman Yu
(74) *Attorney, Agent, or Firm* — Vista IP Law Group, LLP

(57) ABSTRACT

A hearing device includes: a microphone for converting audio into an audio signal; a preprocessing unit for analog processing of the audio signal and having an input and an output, wherein the input is connected to an output of the microphone; an A/D converter for converting the processed analog audio signal into a digital audio signal, the A/D converter having an input and an output, wherein the input of the A/D converter is connected to the output of the preprocessing unit; and a processing unit for digital processing of an output from the A/D converter, wherein the processing unit is connected to the preprocessing unit, and is configured to apply a first transfer function to the audio signal in a first mode of operation, or a second transfer function with a cutoff frequency to the audio signal in a second mode of operation, depending on a control signal.

15 Claims, 6 Drawing Sheets

HEARING DEVICE WITH ANALOG FILTERING AND ASSOCIATED METHOD

RELATED APPLICATION DATA

This application claims priority to and the benefit of European Patent Application No. 12195007.5 filed on Nov. 30, 2012, pending, and Danish Patent Application No. PA 2012 70744 filed on Nov. 30, 2012, pending. The entire disclosures of both of the above-identified applications are expressly incorporated by reference herein.

FIELD

The present application relates to a hearing device or hearing aid with analog filtering and associated method. In particular, the present application relates to a hearing aid having improved wind noise reduction.

BACKGROUND

Wind noise is experienced as very unpleasant by a hearing device user and considerably reduces the user-friendliness of a hearing device. Known methods for reducing wind noise in hearing devices include filtering in the digital domain. Further, it is known to reduce the gain of a preamplifier to remove the uncomfortable sound levels. This however is at the expense of normal sound processing basically getting destroyed rendering the hearing device somewhat unusable.

SUMMARY

Despite the known solutions, there is still a need for improving the hearing device processing during windy conditions and to improve the signal to noise ratio (SNR) in the hearing device.

Accordingly, a hearing device is provided, the hearing device comprising: a microphone for converting audio into an audio signal; a preprocessing unit for analog processing of the audio signal and having an input and an output, wherein the input is connected to an output of the microphone; an A/D converter for converting the processed analog audio signal into a digital audio signal, the A/D converter having an input and an output, wherein the input is connected to the output of the preprocessing unit; and a processing unit for digital processing of A/D converter output, wherein the processing unit is connected to the preprocessing unit. The preprocessing unit is configured to apply a first transfer function to the audio signal in a first mode of operation and a second transfer function with a second cutoff frequency to the audio signal in a second mode of operation, depending on a control signal from the processing unit.

Also disclosed is a method for operating a hearing aid comprising a microphone, a preprocessing unit, an A/D converter, and a processing unit is provided, the method comprising: applying, in the preprocessing unit, a first transfer function to an audio signal from the microphone; converting the preprocessed audio signal to a digital audio signal; determining one or more noise parameters including a first noise parameter: and applying, in the preprocessing unit, a second transfer function, e.g. with a second cutoff frequency, to the audio signal from the microphone depending on a noise criterion, e.g. a first noise criterion, based on the one or more noise parameters. The method may comprise determining the one or more noise parameters while applying the second transfer function, and applying, in the preprocessing unit, the first transfer function or a third transfer function to the audio signal from the microphone depending on a noise criterion, e.g. a second noise criterion.

It is an advantage that saturation of A/D converter of the hearing device is reduced thereby providing improved SNR in the hearing device processing.

Further, the hearing device and method enable a more efficient use of signal processing resources by removing undesired noise at an early stage in the signal processing of the hearing device. Thereby, improved power management is provided.

A hearing device includes: a microphone for converting audio into an audio signal; a preprocessing unit for analog processing of the audio signal and having an input and an output, wherein the input is connected to an output of the microphone; an A/D converter for converting the processed analog audio signal into a digital audio signal, the A/D converter having an input and an output, wherein the input of the A/D converter is connected to the output of the preprocessing unit; and a processing unit for digital processing of an output from the A/D converter, wherein the processing unit is connected to the preprocessing unit; wherein the preprocessing unit is configured to apply a first transfer function to the audio signal in a first mode of operation, or a second transfer function with a cutoff frequency to the audio signal in a second mode of operation, depending on a control signal from the processing unit.

Optionally, the preprocessing unit may include a first capacitor circuit with a variable first capacitance value, wherein the first capacitance value depends on the control signal from the processing unit.

Optionally, the preprocessing unit may include a first resistor circuit with a variable first resistance value, wherein the first resistance value depends on the control signal from the processing unit.

Optionally, the preprocessing unit may include a second resistor circuit with a variable second resistance value, wherein the second resistance value depends on the control signal from the processing unit.

Optionally, the preprocessing unit may include an amplifier.

Optionally, the processing unit may include a detector unit configured to determine one or more noise parameters including a first noise parameter, and wherein the processing unit is configured to send the control signal indicative of one of the first and second modes of operation to the preprocessing unit depending on a noise criterion based on the one or more noise parameter(s).

Optionally, the preprocessing unit may be in the first mode of operation, and the processing unit may be configured to send a control signal indicative of a second mode of operation to the preprocessing unit when a first noise criterion is fulfilled in the first mode of operation.

Optionally, the preprocessing unit may be in the second mode of operation, and the processing unit may be configured to send a control signal indicative of a first mode of operation to the preprocessing unit when a second noise criterion is fulfilled in the second mode of operation.

Optionally, the preprocessing unit may be configured to apply a third transfer function with a cutoff frequency to the audio signal in a third mode of operation as an alternative to the first mode and the second mode of operation depending on the control signal from the processing unit.

Optionally, the first transfer function may be a high pass filter function and having a cutoff frequency, wherein the cutoff frequency of the first transfer function is anywhere in a range from 100 Hz to 1 kHz.

Optionally, the cutoff frequency of the second transfer function may be larger than the cutoff frequency of the first transfer function.

Optionally, the second transfer function may be a high pass filter function, and wherein the cutoff frequency may be anywhere in a range from 100 Hz to 2 kHz.

Optionally, the audio signal may include a first part that corresponds with a first time point, and a second part that corresponds with a second time point; and the preprocessing unit may be configured to apply one of the first transfer function and the second transfer function to the first part of the audio signal based on a first value of the control signal from the processing unit, and another one of the first transfer function and the second transfer function to the second part of the audio signal based on a second value of the control signal from the processing unit.

A method for operating a hearing aid comprising a microphone, a preprocessing unit, an A/D converter, and a processing unit, includes: applying, in the preprocessing unit, a first transfer function to a first part of an audio signal from the microphone to obtain a preprocessed audio signal; converting the preprocessed audio signal to a digital audio signal; determining one or more noise parameters including a first noise parameter; and applying, in the preprocessing unit, a second transfer function with a cutoff frequency to a second part of the audio signal from the microphone depending on a noise criterion based on the one or more noise parameters; wherein the first part and the second part of the audio signal correspond to different respective time points.

Optionally, the one or more noise parameters may be determined while the second transfer function is being applied.

Optionally, the method may also include applying, in the preprocessing unit, the first transfer function or a third transfer function to a third part of the audio signal from the microphone depending on another noise criterion.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of the scope of the claims.

DETAILED DESCRIPTION

Figure 1:
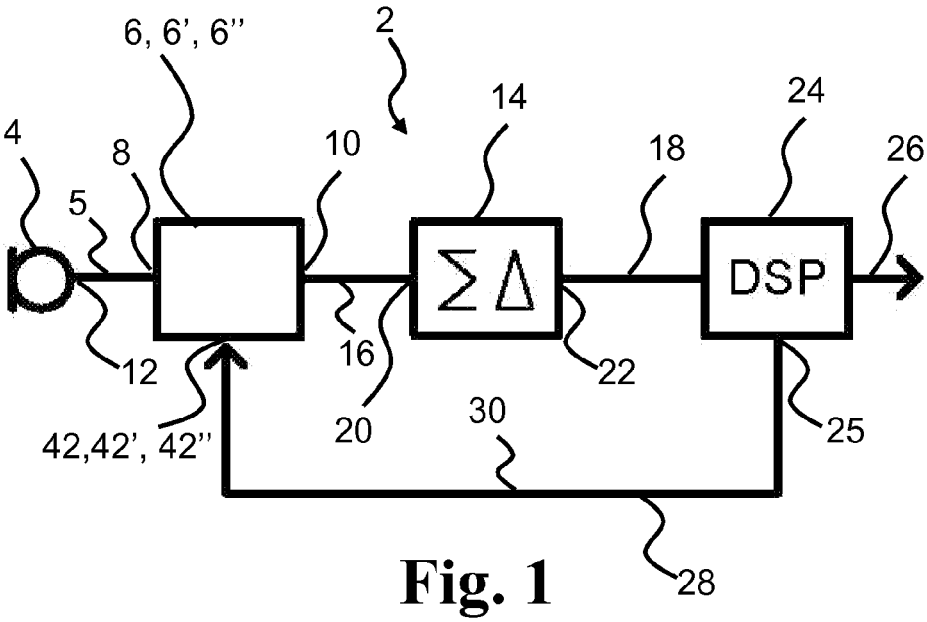
FIG. 1 schematically illustrates an exemplary hearing device.

Various embodiments are described hereinafter with reference to the figures. It should be noted that the figures are not drawn to scale and that the elements of similar structures or functions are represented by like reference numerals throughout the figures. It should be noted that the figures are only intended to facilitate the description of the embodiments. They are not intended as an exhaustive description of the invention or as a limitation on the scope of the claimed invention. In addition, an illustrated embodiment need not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

The preprocessing unit processes the audio signal from the microphone and has an input and an output. The input comprises a first input terminal connected to an output, e.g. a first output terminal, of the microphone. The preprocessing unit may comprise one or more control terminals for receiving and/or sending control signal(s) from/to the processing unit.

The preprocessing unit may comprise a first capacitor circuit with a first capacitance value. The first capacitance value may be variable, e.g. the first capacitance value may depend on the control signal from the processing unit. The preprocessing unit may comprise a second capacitor or second capacitor circuit having a second capacitance value. The second capacitance value may be variable, e.g. the second capacitance value may depend on the control signal from the processing unit. A variable first and/or second capacitance circuit may reduce the microphone requirements with regard to DC biasing or drifting. A capacitor or capacitor circuit has a first and a second terminal having a capacitance value therebetween.

The preprocessing unit may comprise a first resistor circuit with a first resistance value. The first resistance value may be variable, e.g. the first resistance value may depend on the control signal from the processing unit. The preprocessing unit may comprise a second resistor circuit with a second resistance value. The second resistance value may be variable, e.g. the second resistance value may depend on the control signal from the processing unit. A resistor or resistor circuit has a first and a second terminal having a resistance value therebetween.

The preprocessing unit may be a passive unit or an active unit. Accordingly, the preprocessing unit may comprise an amplifier. The amplifier has a first and optionally a second input terminal and an output terminal. The preprocessing unit may comprise a first part or unit and a second part or unit, where the first part is a passive filter part with adjustable filter parameters via the control signal and the second part is an active part with an amplifier. Accordingly, the preprocessing unit may comprise a passive adjustable filter unit followed by an active amplifier unit with adjustable gain.

The processing unit comprises an input with one or more input terminals including a first input terminal. The processing unit comprises one or more control terminals connected to corresponding control terminals of the preprocessing unit for sending and/or receiving control signal(s) indicative of mode of operation to/from the preprocessing unit.

The processing unit is configured to send a control signal to the preprocessing unit indicative of a mode of operation. The control signal may comprise one or more bits, e.g. depending on the number of modes/transfer functions. The control signal may have a first value indicative of the first transfer function (e.g. Bit1=0) and a second value indicative of a second transfer function (e.g. Bit1=1). The processing unit may comprise a detector unit configured to determine one or more noise parameters including a first noise parameter and/or a second noise parameter. The noise parameter(s) may be indicative of the amount of wind noise in the audio signal. The processing unit may be configured to send a control signal indicative of mode of operation to the preprocessing unit depending on a noise criterion based on one or more of the noise parameters. The detector unit may be configured to determine a saturation parameter indicative of whether the A/D converter is close to or in saturation. The processing unit may be configured to send a control signal indicative of mode of operation to the preprocessing unit based on the saturation parameter.

A noise criterion may be applied for determining the mode of operation. For example, a first mode (first transfer function) may be selected when a noise criterion, e.g. a first noise criterion, based on noise parameter(s) is not fulfilled, e.g. if a first noise parameter is less than, equal to or larger than a noise threshold (e.g. a first noise threshold). Further, a second mode (second transfer function) may be selected when a noise criterion, e.g. the first noise criterion or a second noise criterion, based on the noise parameter(s) is fulfilled, e.g. if the first noise parameter is less than, equal to or larger than a noise threshold (e.g. the first noise threshold or a second noise threshold). Different criteria may be applied depending on the mode of operation.

In an exemplary hearing device, a noise parameter may be based on the sound pressure level (SPL) of the digital audio signal and/or the sound pressure level (SPL) in one or more frequency bands of the digital audio signal, e.g. a first frequency band $F_1$ and/or a second frequency band $F_2$. It is contemplated that a noise criterion and/or the noise parameter may be based on SPL or other suitable input signal properties determined by the detector unit or other sound classification units in the hearing device.

In an exemplary hearing device, a noise criterion in the first mode of operation is given by $$SPL_{total}>T_1$$

where the first noise parameter $SPL_{total}$ is the sound pressure level of the digital audio signal and $T_1$ is a first noise threshold. A first transfer function is applied (first mode of operation) if the noise criterion is not fulfilled (false, indicative of no or little wind noise) and a second transfer function is applied (second mode of operation) if the noise criterion is fulfilled (true, indicative of wind noise present).

In an exemplary hearing device, the noise criterion in the first mode of operation is given by $$SPL_{F1}>T_1$$

where the first noise parameter $SPL_{F1}$ is the sound pressure level of the digital audio signal in a first frequency band $F_1$ and $T_1$ is a first noise threshold. A first transfer function is applied (first mode of operation) if the noise criterion is not fulfilled (false, indicative of no or little wind noise) and the preprocessing unit switches to applying a second transfer function (second mode of operation) if the noise criterion is fulfilled (true, indicative of wind noise present).

The noise criterion may be based on a plurality of noise parameters. In an exemplary hearing device, the noise criterion in the first mode of operation is given by $$(SPL_{total}>T_1) \text{ AND } (SPL_{F1}>T_2)$$

where the first noise parameter $SPL_{total}$ is the sound pressure level of the digital audio signal, $T_1$ is a first noise threshold, the second noise parameter $SPL_{F1}$ is the sound pressure level of the digital audio signal in a first frequency band $F_1$, and $T_2$ is a second noise threshold.

A first noise criterion may be applied in a first mode of operation and a second noise criterion different from the first noise criterion may be applied in a second mode of operation. The hearing device may be configured to operate in the second mode for a predetermined time period and then switch back to the first mode. For example, the second noise criterion may consist of or include whether the hearing device has operated in the second mode for a certain period of time. A noise criterion may comprise one or more logical expressions.

The preprocessing unit may be configured to apply a third transfer function with a third cutoff frequency to the audio signal in a third mode of operation depending on the control signal from the processing unit.

The preprocessing unit is configured to apply a plurality of different transfer functions including a first transfer function and a second transfer function to the output signal from the microphone in different modes of operation, e.g. depending on control signal(s) from the processing unit.

The first transfer function may be a high pass filter function having a first cutoff frequency $f_1$. The first cutoff frequency may be selected in the range from 5 Hz to 1 kHz. Exemplary first cutoff frequencies are 20 Hz, 50 Hz, 80 Hz, 100 Hz, 200 Hz, 400 Hz, 600 Hz, 1 kHz or any ranges therebetween.

The second transfer function may be a high pass filter function. The second cutoff frequency $f_2$ may be selected in the range from 50 Hz to 2 kHz. Exemplary second cutoff frequencies are 50 Hz, 80 Hz, 100 Hz, 200 Hz, 400 Hz, 600 Hz, 800 Hz, 1 kHz, 2 kHz or any ranges therebetween. The first cutoff frequency may be less than the second cutoff frequency, e.g. $f_1$=80 Hz and $f_2$=400 Hz.

The transfer functions applied in different modes may be band-pass filter functions with lower cutoff corresponding to the first and second cutoff frequencies, respectively.

The processing unit may be configured to send a control signal indicative of a second mode of operation to the preprocessing unit when a first noise criterion is fulfilled in a first mode of operation where a first transfer function is applied. Additionally or as an alternative, the processing unit may be configured to send a control signal indicative of a first mode of operation to the preprocessing unit when a second noise criterion is fulfilled in a second mode of operation where a second transfer function is applied.

The method according some embodiments comprises applying, in the preprocessing unit, a second transfer function with a second cutoff frequency to the audio signal from the microphone if the noise parameter fulfills a criterion. The method may comprise determining the noise parameter(s) while applying the second transfer function, and applying, in the preprocessing unit, the first transfer function or a third transfer function to the audio signal from the microphone if the noise parameter(s) fulfills a criterion. A first criterion may be applied when the first transfer function is applied in the preprocessing unit and a second criterion different from the first criterion may be applied when the second transfer function is applied in the preprocessing unit.

The hearing device according to some embodiments provides improved degree of freedom in the design of the hearing device by reducing the requirements to microphone performance.

Further, one or more embodiments described herein allow for utilizing low frequency audio signals for secondary applications not necessarily related to hearing loss compensation.

FIG. 1 schematically illustrates an exemplary hearing device. The hearing device 2 comprises a microphone 4 for converting audio into an audio signal 5, and a preprocessing unit 6 for analog processing of the audio signal 5. The preprocessing unit has an input 8 for audio signal 5 and an output 10, wherein the input 8 is connected to an output 12 of the microphone 4. Further, the hearing device 2 comprises an A/D converter 14 for converting the processed analog audio signal 16 into a digital audio signal 18, the A/D converter 14 having an input 20 and an output 22, wherein the input 20 is connected to the output 10 of the preprocessing unit 6. The hearing device comprises a processing unit 24 for digital processing of the digital audio signal 18. The processed digital audio signal 26 is fed to a receiver device (not shown) for conversion of the processed digital audio signal 26 into a compensated audio signal. The processing unit 24 is connected to the preprocessing unit 6 on connection 28 for feeding and/or receiving control signal(s) to/from the preprocessing unit.

The preprocessing unit 6 is configured to apply a first transfer function $H_1$ to the audio signal in a first mode of operation and a second transfer function $H_2$ with a second cutoff frequency to the audio signal in a second mode of operation, depending on a control signal 30 on connection 28 from the processing unit 24.

Figure 2:
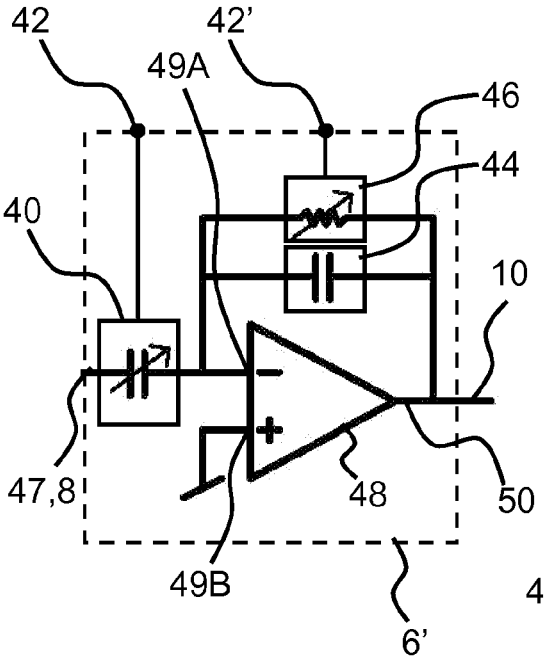
FIG. 2 schematically illustrates an exemplary preprocessing circuit of the hearing device in FIG. 1, FIG. 3 schematically illustrates an exemplary preprocessing circuit of the hearing device in FIG. 1.

FIG. 2 shows an exemplary preprocessing unit 6' of the hearing aid 2. The preprocessing unit 6' comprises a first capacitance circuit 40 with a variable first capacitance value C1 depending on a control signal on control terminal(s) 42. Further, the preprocessing unit 6' comprises a second capacitance circuit 44 with a second capacitance value C2. The preprocessing unit 6' comprises a first resistance circuit 46 with a variable first resistance value R1 depending on a control signal on control terminal(s) 42'. The preprocessing unit 6' is an active unit comprising an amplifier or amplifier circuit 48 having a first input terminal 49A, a second input terminal 49B, and output terminal 50 coupled to the capacitance and resistance circuits 40, 44, 46. The first capacitance circuit 40 is coupled between a first input terminal 47 of the preprocessing unit input 8 and the first input terminal 49A. The second capacitance circuit 44 and the first resistance circuit 46 are coupled in parallel between the first input terminal 49A and the output terminal 50. The second input terminal 49B is connected to virtual ground.

Figure 3:
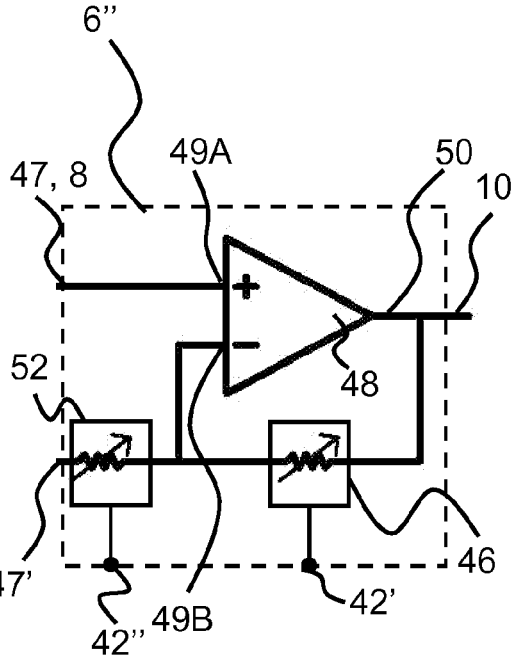

FIG. 3 shows an exemplary preprocessing unit 6" of the hearing aid 2. The preprocessing unit 6" comprises a first resistance circuit 46 with a variable first resistance value R1 depending on a control signal on control terminal(s) 42'. Further, the preprocessing unit 6" comprises a second resistance circuit 52 with a variable second resistance value R2 depending on a control signal on control terminal(s) 42". The preprocessing unit 6" is an active unit comprising an amplifier or amplifier circuit 48 having a first input terminal 49A, a second input terminal 49B, and output terminal 50. The first resistance circuit 46 is coupled between the second input terminal 49B and the output terminal 50. The second resistance circuit 52 is coupled between the second input terminal 49B and the second input terminal 47" of the preprocessing unit. A capacitance circuit (not shown) is coupled external to the preprocessing unit between the second input terminal 47' and ground. As an alternative or in combination, a first capacitance circuit (C1) may be incorporated in the preprocessing unit 6" in series with the second resistance circuit 52 between ground and the second input terminal 49B.

Figure 4:
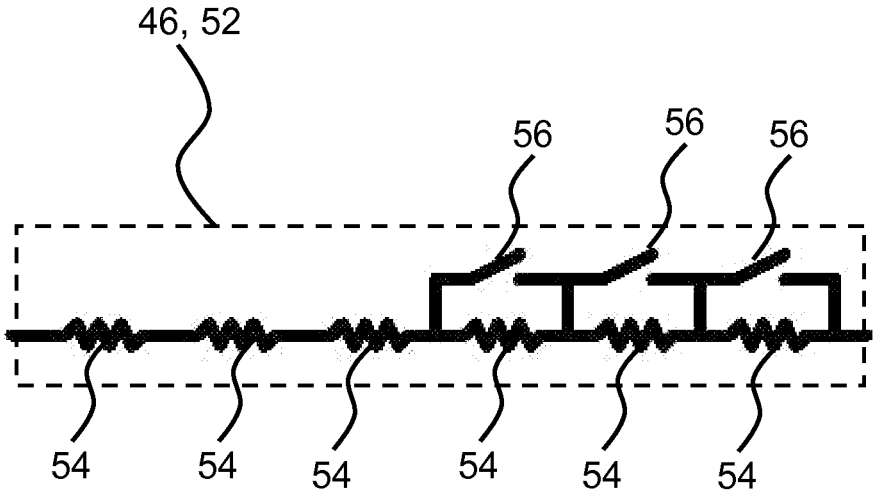
FIG. 4 shows an exemplary resistance circuit with a variable resistance value.

FIG. 4 shows an exemplary resistance circuit with a variable resistance value. Different resistance values may be selected by controlling the switches 56 (open or closed) with a control signal in order to couple or decouple resistors 54.

Figure 5:
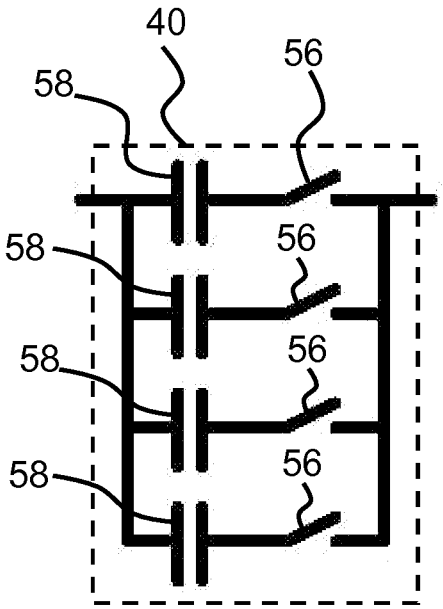
FIG. 5 shows an exemplary capacitance circuit with a variable capacitance value.

FIG. 5 shows an exemplary capacitance circuit with a variable capacitance value. Different capacitance values may be selected by controlling the switches 56 (open or closed) with a control signal in order to couple or decouple capacitors 58.

Figure 6:
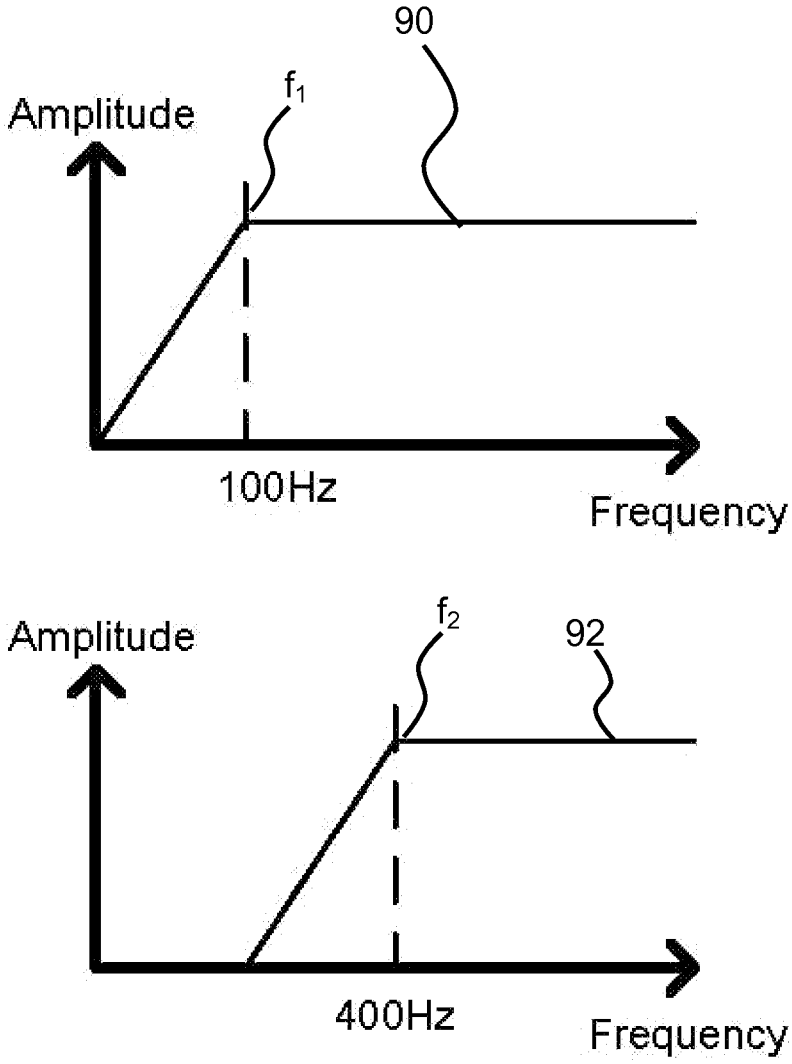
FIG. 6 shows exemplary first and second transfer functions.

FIG. 6 shows exemplary first and second transfer functions applied to the audio signal in first and second modes of operation, respectively. The first transfer function 90 is a high pass filter with a first cutoff frequency $f_1$ of about 100 Hz. The second transfer function 92 is a high pass filter with a second cutoff frequency $f_2$ of about 400 Hz.

Figure 7:
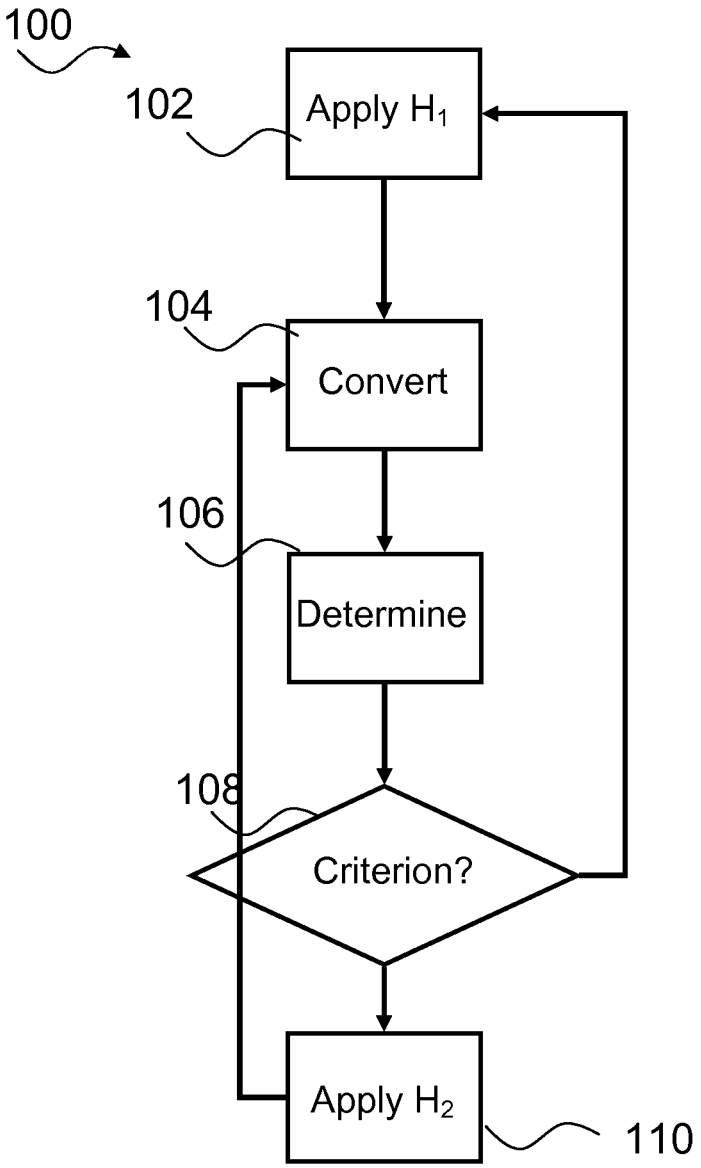
FIG. 7 is a flow diagram of an exemplary method.

FIG. 7 illustrates an exemplary method for operating a hearing aid comprising a microphone, a preprocessing unit, an A/D converter, and a processing unit according to some embodiments. The method 100 comprises applying 102, in the preprocessing unit, a first transfer function $H_1$ to an audio signal from the microphone and converting 104 the preprocessed audio signal to a digital audio signal with the A/D converter. Further, the method comprises determining 106 one or more noise parameters including a first noise parameter and/or a second noise parameter of the digital audio signal, and applying 110, in the preprocessing unit, a second transfer function $H_2$ with a second cutoff frequency $f_2$ to the audio signal from the microphone depending on a noise criterion 108 based on the one or more noise parameters. In the method 100, the noise criterion applied in 108 depends on the mode of operation. If the preprocessing unit applies a first transfer function corresponding to the first mode of operation, a first criterion based on sound pressure levels is applied. If the first criterion is fulfilled, e.g. one or more sound pressure levels (total and/or selected bandwidths) are larger than respective thresholds, a control signal indicative of second mode is fed to the preprocessing unit and the preprocessing unit applies a second transfer function 110. If the first criterion is not fulfilled (indicative of no wind noise), the preprocessing unit continues applying the first transfer function corresponding to the hearing device operating in the first mode of operation. If the preprocessing unit applies a second transfer function corresponding to the second mode of operation, a second criterion is applied in 108. The second criterion may be fulfilled if the hearing device has operated in the second mode for a certain time period, i.e. if $t_2>T_1$, where $t_2$ is the present time of operation in the second mode and $T_1$ is a threshold time, e.g. in the range from 1 second to 60 seconds. If the second criterion is fulfilled, a control signal indicative of first mode is fed to the preprocessing unit and the preprocessing unit applies a first transfer function 102. If the second criterion is not fulfilled (indicative of wind noise present), the preprocessing unit continues applying the second transfer function and the hearing device continues operating in the second mode of operation.

Figure 8:
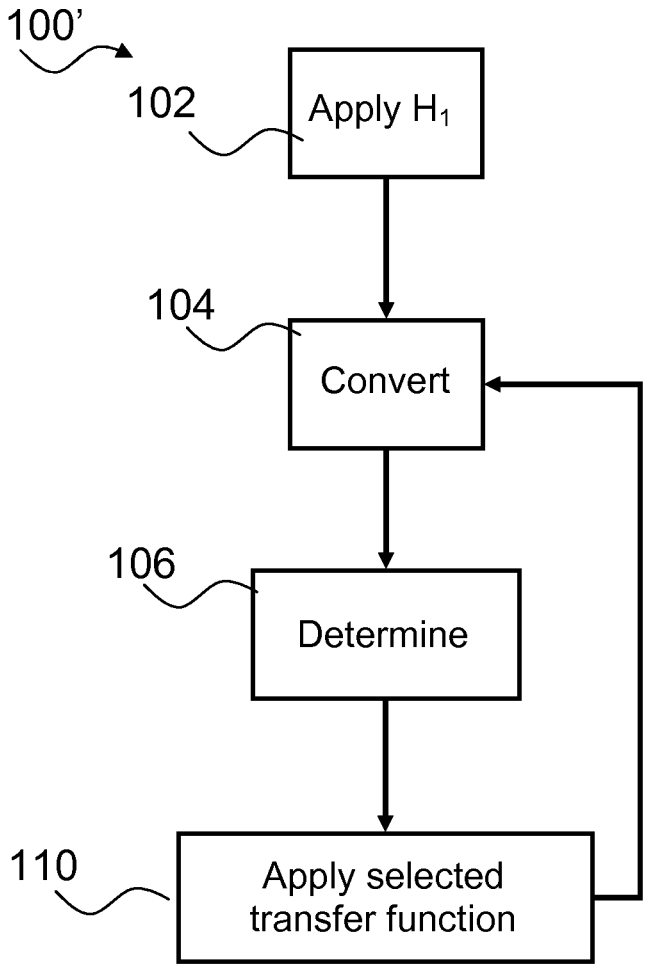
FIG. 8 is a flow diagram of an exemplary method.

FIG. 8 illustrates an exemplary method for operating a hearing aid comprising a microphone, a preprocessing unit, an A/D converter, and a processing unit according to some embodiments. The method 100' comprises applying 102, in the preprocessing unit, a first transfer function $H_1$ to an audio signal from the microphone and converting 104 the preprocessed audio signal to a digital audio signal with the A/D converter. Further, the method comprises determining 106 one or more noise parameters including a first noise parameter and/or a second noise parameter of the digital audio signal. Further, an operation mode of the hearing device is determined based on the one or more noise parameters and the current mode of operation in 106. The operation mode may be selected from two or more operation modes with corresponding transfer functions. In 110, the transfer function corresponding to the mode of operation determined in 106 is applied to the audio signal and the method returns to determining the mode of operation and accordingly the transfer function to be applied in the preprocessing unit.

Figure 9:
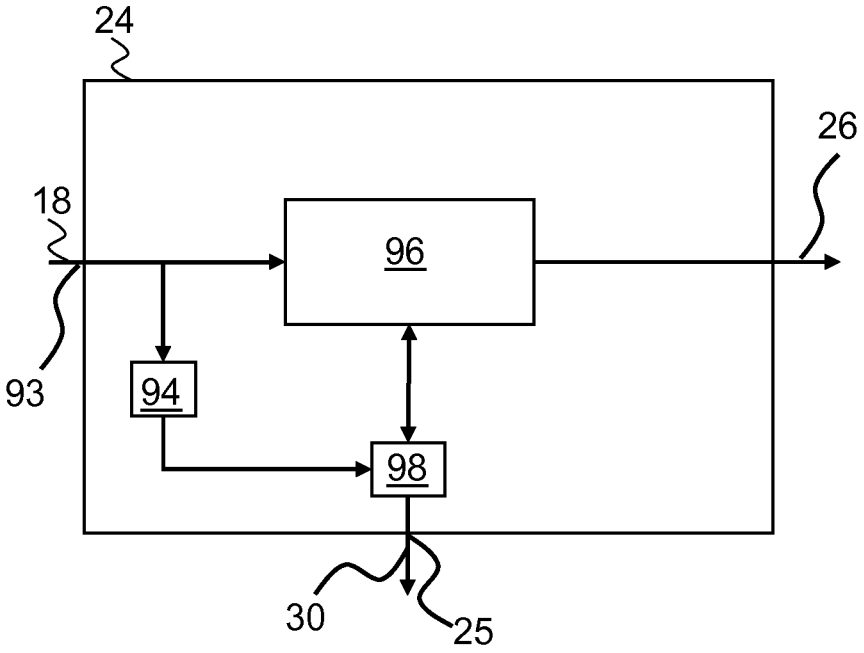
FIG. 9 shows an exemplary processing unit.

FIG. 9 shows an exemplary processing unit 24. The processing unit 24 receives the digital audio signal 18 at input 93. The digital audio signal 18 is fed to detector unit 94 and hearing compensation processing unit 96. The detector unit 94 is configured to determine at least a first noise parameter of the digital audio signal 18. The noise parameter(s) are fed to mode selector 98 configured to determine the mode of operation of the hearing aid, e.g. based on the noise parameter(s) and/or current mode of operation. The mode selector 98 may be embedded in the hearing compensation processing unit 96. The mode selector 98 is configured to send a control signal 30 indicative of mode of operation to the preprocessing unit via processing unit control output 25.

Although particular embodiments have been shown and described, it will be understood that they are not intended to limit the claimed invention, and it will be made obvious to those skilled in the art that various changes and modifications may be made without departing from the spirit and scope of the claimed invention. The specification and drawings are, accordingly, to be regarded in an illustrative rather than restrictive sense. The claimed invention is intended to cover alternatives, modifications, and equivalents.

LIST OF REFERENCES

2 hearing device
4 microphone
5 audio signal
6 preprocessing unit
8 preprocessing unit input
10 preprocessing unit output
12 microphone output
14 analog-digital (A/D) converter
16 processed analog audio signal
18 digital audio signal
20 A/D converter input
22 A/D converter output
24 processing unit
25 processing unit control output
26 processed digital audio signal
28 connection
30 control signal
40 first capacitance circuit
42, 42', 42" control terminal(s)
44 second capacitance circuit
46 first resistance circuit
47 first input terminal
48 amplifier
49A first input terminal of amplifier
49B second input terminal of amplifier
50 output terminal of amplifier
52 second resistance circuit
54 resistor
56 switch
58 capacitor
90 first transfer function
92 second transfer function
93 digital audio input
94 detector unit
96 hearing compensation processing unit
98 mode selector

The invention claimed is:

1. A hearing device comprising:

a microphone for converting audio into an audio signal;

a preprocessing unit for analog processing of the audio signal and having an input and an output, wherein the input is connected to an output of the microphone;

an A/D converter for converting the processed analog audio signal into a digital audio signal, the A/D converter having an input and an output, wherein the input of the A/D converter is connected to the output of the preprocessing unit; and a processing unit for digital processing of an output from the A/D converter, wherein the processing unit is connected to the preprocessing unit;

wherein the preprocessing unit is configured to apply a first transfer function to the audio signal in a first mode of operation, or a second transfer function with a cutoff frequency to the audio signal in a second mode of operation, depending on a control signal from the processing unit; and wherein the preprocessing unit comprises a first capacitor circuit with a variable first capacitance value, wherein the first capacitance value depends on the control signal from the processing unit.

2. The hearing device according to claim 1, wherein the preprocessing unit comprises a first resistor circuit with a variable first resistance value, wherein the first resistance value depends on the control signal from the processing unit.

3. The hearing device according to claim 2, wherein the preprocessing unit comprises a second resistor circuit with a variable second resistance value, wherein the second resistance value depends on the control signal from the processing unit.

4. The hearing device according to claim 1, wherein the preprocessing unit comprises an amplifier.

5. The hearing device according to claim 1, wherein the processing unit comprises a detector unit configured to determine one or more noise parameters including a first noise parameter, and wherein the processing unit is configured to send the control signal indicative of one of the first and second modes of operation to the preprocessing unit depending on a noise criterion based on the one or more noise parameter(s).

6. The hearing device according to claim 1, wherein the preprocessing unit is in the first mode of operation; and wherein the processing unit is configured to send a control signal indicative of a second mode of operation to the preprocessing unit when a first noise criterion is fulfilled in the first mode of operation.

7. The hearing device according to claim 1, wherein the preprocessing unit is in the second mode of operation; and wherein the processing unit is configured to send a control signal indicative of a first mode of operation to the preprocessing unit when a second noise criterion is fulfilled in the second mode of operation.

8. The hearing device according to claim 1, wherein the preprocessing unit is configured to apply a third transfer function with a cutoff frequency to the audio signal in a third mode of operation as an alternative to the first mode and the second mode of operation depending on the control signal from the processing unit.

9. The hearing device according to claim 1, wherein the first transfer function is a high pass filter function and having a cutoff frequency, wherein the cutoff frequency of the first transfer function is anywhere in a range from 100 Hz to 1 kHz.

10. The hearing device according to claim 9, wherein the cutoff frequency of the second transfer function is larger than the cutoff frequency of the first transfer function.

11. The hearing device according to claim 1, wherein the second transfer function is a high pass filter function, and wherein the cutoff frequency is anywhere in a range from 100 Hz to 2 kHz.

12. The hearing device according to claim 1, wherein the audio signal comprises a first part that corresponds with a first time point, and a second part that corresponds with a second time point; and wherein the preprocessing unit is configured to apply one of the first transfer function and the second transfer function to the first part of the audio signal based on a first value of the control signal from the processing unit, and another one of the first transfer function and the second transfer function to the second part of the audio signal based on a second value of the control signal from the processing unit.

13. A method for operating a hearing aid comprising a microphone, a preprocessing unit, an A/D converter, and a processing unit, the method comprising:

applying, in the preprocessing unit, a first transfer function to a first part of an audio signal from the microphone to obtain a preprocessed audio signal;

converting the preprocessed audio signal to a digital audio signal;

determining one or more noise parameters including a first noise parameter; and applying, in the preprocessing unit, a second transfer function with a cutoff frequency to a second part of the audio signal from the microphone depending on a noise criterion based on the one or more noise parameters;

wherein the first part and the second part of the audio signal correspond to different respective time points.

14. The method according to claim 13, wherein the one or more noise parameters are determined while the second transfer function is being applied.

15. The method according to claim 13, further comprising applying, in the preprocessing unit, the first transfer function or a third transfer function to a third part of the audio signal from the microphone depending on another noise criterion.

* * * * *